US006984269B2

(12) United States Patent
Motson

(10) Patent No.: US 6,984,269 B2
(45) Date of Patent: Jan. 10, 2006

(54) CLEANING SURFACES

(75) Inventor: Harold Russell Motson, Norton (GB)

(73) Assignee: Imperial Chemical Industries PLC, London (GB)

( * ) Notice: Subject to any disclaimer, the term of this patent is extended or adjusted under 35 U.S.C. 154(b) by 300 days.

(21) Appl. No.: 10/303,108

(22) Filed: Nov. 25, 2002

(65) Prior Publication Data

US 2003/0148905 A1 Aug. 7, 2003

Related U.S. Application Data

(63) Continuation of application No. PCT/GB01/02263, filed on May 22, 2001.

(60) Provisional application No. 60/207,963, filed on May 31, 2000.

(30) Foreign Application Priority Data

May 24, 2000 (GB) ..... 0012491

(51) Int. Cl.
*C11D 17/00* (2006.01)
*C11D 7/50* (2006.01)

(52) U.S. Cl. ..... 134/38; 510/407; 510/417; 510/505

(58) Field of Classification Search ..... 134/38; 510/407, 417, 505
See application file for complete search history.

(56) References Cited

U.S. PATENT DOCUMENTS

| | | | | |
|---|---|---|---|---|
| 3,953,344 A | * | 4/1976 | Narushima | 508/408 |
| 4,956,115 A | | 9/1990 | Van De Mark | |
| 5,612,303 A | | 3/1997 | Takayanagi et al. | |
| 5,719,114 A | | 2/1998 | Zocchi et al. | |

FOREIGN PATENT DOCUMENTS

| | | |
|---|---|---|
| GB | 1278357 | 6/1972 |
| JP | 03 074495 A | 3/1991 |
| JP | 09 059677 A | 3/1997 |
| WO | WO 99/00025 | 1/1999 |

* cited by examiner

*Primary Examiner*—Gregory Webb
(74) *Attorney, Agent, or Firm*—Mayer Brown Rowe & Maw LLP

(57) ABSTRACT

Substrates are cleaned by contacting the substrate with a cleaning composition, particularly an aqueous composition, including at least one compound of the formula (I): $(R^2)_p$—Ph—$(CH_2)_m$—COO—$(AO)_n$—$R^1$ (I) where $R^1$, AO, n, M, Ph, $R^2$ and p have defined meanings, particularly to give alkyl benzoates. Such compounds provide useful solvency to the cleaning formulations while having a relatively benign environmental profile.

27 Claims, No Drawings

CLEANING SURFACES

CROSS REFERENCE TO RELATED APPLICATIONS

This application is a continuation of International Application No. PCT/GB01/02263, filed May 22, 2001, and further claims benefit from U.S. Provisional Application No. 60/207,963, filed May 31, 2000. These applications, in their entirety, are incorporated herein by reference.

This invention relates to the cleaning of surfaces, in particular, to methods of domestic, institutional and industrial cleaning of hard surfaces, and to cleaning compositions.

In cleaning of hard surfaces, particularly those of metals, ceramics, glass and plastics, the cleaning processes typically involve treating the substrate to be cleaned with a cleaning fluid which aids physical or chemical dissolution or dispersion of soil on the surface being cleaned. The cleaning process, particularly in the domestic environment, may include mechanical action as rubbing or scrubbing. However, in institutional cleaning it is desirable for economic reasons to reduce mechanical rubbing or scrubbing and in industrial cleaning it is generally desirable to avoid it if possible, because it is difficult to use uniformly and is expensive. Particularly in industrial cleaning, energy to assist cleaning may be supplied by agitation or using ultrasound.

In all these types of cleaning, solvents are frequently used to improve soil removal by dissolving soil material, particularly oily, greasy or fatty solid, from the surface and/or top soften soils that are in the form of a coherent coating e.g. paint that is desired to be removed (stripped) from a painted substrate or for the removal of graffiti. Alkali materials can be included e.g. moderately strong alkali such as soda ash (sodium carbonate) as a buffer and/or builder, or strong alkali such as caustic soda (sodium hydroxide) which can improve the removal fatty, waxy or oily soils particularly by hydrolysis of ester fats and oils. Surfactant, usually synthetic surfactant, materials are also commonly included to improve wetting of, and to aid keeping detached contaminants suspended away from the substrate surface being cleaned. Compositions of this general type are known as cleaners and particularly as so-called "hard surface cleaners".

This invention is based on our discovery that certain aromatic acid esters are useful solvents for use in cleaning methods and inclusion in cleaning compositions. The invention includes methods of hard surface cleaning, for domestic, institutional and industrial applications, degreasing, particularly metal degreasing, vehicle cleaning and paint removal including paint stripping and graffiti removal and cleaning compositions suitable for use in such methods.

The present invention accordingly provides a method of cleaning a substrate, which includes contacting the substrate to be cleaned with a composition, particularly and aqueous composition, including at least one compound of the formula (I):

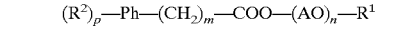

$$(R^2)_p—Ph—(CH_2)_m—COO—(AO)_n—R^1 \quad (1)$$

where $R^1$ is a $C_1$ to $C_{20}$ alkyl or alkenyl group, particularly a $C_1$ to $C_{10}$ alkyl group, more particularly a $C_1$ to $C_6$ alkyl group, especially a $C_3$ to $C_5$ branched alkyl group;

AO is an alkyleneoxy group, particularly an ethyleneoxy or a propyleneoxy group, and may vary along the (poly)alkyleneoxy chain;

n 0 or from 1 to 100, desirably 0;

m is 0, 1 or 2, desirably 0; and

Ph is a phenyl group, which may be substituted with groups $(R^2)_p$; where each $R^2$ is independently a $C_1$ to $C_4$ alkyl or alkoxy group; and p is 0, 1 or 2, desirably 0.

In this method, typically, the substrate will be contacted with a surfactant, usually a detergent surfactant, together with the compound of the formula (I). Most usually, the surfactant containing composition will be an aqueous composition, usually in the form of an oil in water emulsion, where the oil disperse phase is of includes a compound of the formula (I). The invention accordingly further provides a method of cleaning a substrate which includes contacting the substrate to be cleaned in which an aqueous cleaning composition, particularly in the form of an oil in water emulsion, which includes a compound of the formula (I) together with a surfactant, particularly a detergent surfactant.

The invention further includes:

a method of degreasing a substrate, particularly a metal substrate in which the substrate to be degreased is contacted with a composition, particularly an aqueous composition, including at least one compound of the formula (I);

a method of hard surface cleaning in which a substrate to be cleaned is contacted with a composition, particularly an aqueous composition, including at least one compound of the formula (I) together with a surfactant, particularly a detergent surfactant, and a builder or alkali;

a method of cleaning graffiti from a surface in which the surface to be cleaned is contacted with a composition, particularly an aqueous composition, including at least one compound of the formula (I) together with a surfactant, particularly a detergent surfactant, and optionally a builder and/or alkali;

a method of stripping paint from a substrate in which a painted substrate is contacted with a composition, particularly an aqueous composition, including at least one compound of the formula (I) together with a surfactant, particularly a detergent surfactant;

a method of rig cleaning in which the surface of the rig to be cleaned is contacted with a composition, particularly an aqueous composition, especially a microemulsion formulation, including at least one compound of the formula (I) together with a surfactant, particularly a detergent surfactant; and the use of compounds of the formula (I), as defined above, in cleaning surfaces, particularly in hard surface cleaning. As is discussed below, desirably the compound used in or includes iso-propyl benzoate.

In compounds of the formula (I) the group $R^1$ is a is a $C_1$ to $C_{20}$ alkyl or alkenyl group, $C_1$ to $C_{10}$ alkyl group. Desirably $R^1$ is a $C_1$ to $C_6$ alkyl group, and is particularly branched e.g. it is an iso-propyl (prop-2-yl), sec-butyl (but-2-yl), iso-butyl (2-methyl-prop1-yl) and/or tert-butyl, group, to reduce the ease with which the ester can be hydrolysed. Esters with secondary alcohols are particularly useful in this regard and $R^1$ is thus especially a $C_3$ to $C_5$ secondary alkyl group and very desirably an iso-propyl group. Although generally desirably, the alkyl group $R^1$ is a relatively short chain, particularly a $C_1$ to $C_6$ alkyl, group, it may be a longer chain group as in a $C_6$ to $C_{20}$ alkyl or alkenyl group, particularly a $C_8$ to $C_{18}$ alkyl or alkenyl group which may be straight chain e.g. as in mixed esters such as (mixed $C_{12}/C_{13}$ alkyl) benzoate, or branched e.g. as in 2-ethylhexyl or iso-nonyl or branched chain $C_{18}$ alkyl as in so-called iso-stearyl (actually a mixture of mainly branched $C_{14}$ to $C_{22}$ alkyl with an average chain length close to $C_{18}$). Unsaturated longer chain groups include oleyl. Where longer chain length groups are used, particularly longer than $C_{12}$, it is desirable that are or include branching and/or unsaturation and/or that mixtures of such esters are used, as these tend to be more liquid than straight chain saturated esters.

Although the carboxylic acid used in the ester can be a dihydrocinnamic acid or a phenylacetic acid, it is very desirably a benzoic acid i.e. desirably m is 0. Similarly, although the phenyl ring of the acid may be substituted, it is desirable that it is unsubstituted i.e. desirably p is 0.

The esters used in the invention may include a (poly) alkyleneoxy chain between the carboxyl group and the group $R^1$. When present the (poly)alkyleneoxy chain is desirably a (poly)ethyleneoxy, a (poly)propyleneoxy chain or a chain including both ethyleneoxy and propyleneoxy residues. Generally, it is desirably not to include such a chain in the ester i.e. desirably n is 0.

A particularly useful ester is iso-propyl benzoate and the invention specifically includes a method of cleaning in which iso-propyl benzoate is used as a or the compound of the formula (I). Iso-propyl benzoate has a combination of properties that make it particularly useful in that, as a pure material, it has a wide liquid range (BP ca 219° C. a pour point <−60° C.); it is classified as non-flammable (flash point ca 99° C.) and under normal use conditions it has a low vapour pressure.

The compound(s) of the formula (I) can be used in admixture with other organic solvent materials including those known for use in cleaning formulations. These materials include hydrocarbons particularly $C_5$ to $C_{18}$ hydrocarbons particularly paraffins e.g. mineral spirits and mineral oil hydrocarbon paraffin fractions, or terpeneoid hydrocarbons such as d-limonene; halogenated, particularly chlorinated and/ore fluorinated, hydrocarbons, particularly $C_1$ to $C_{14}$ compounds, alcohols, particularly $C_2$ to $C_8$ alkanols such as, ethanol, iso-propanol and iso-hexanol; glycols such as monoethylene glycol and monopropylene glycol; glycol ethers such as butyl ethoxol and butyl diglycol. Generally, particularly because the compounds of the formula (I) have good environmental profiles, known solvents having poor environmental profiles e.g. chlorinated hydrocarbons and volatile hydrocarbons will not be used, but solvents known to have low adverse environmental impact e.g. terpenes such as d-limonene may readily be included in cleaning compositions used in the invention.

When mixtures are used, compounds of the formula (I) will typically be present in at least 10%, usually at least 25%, more usually at least 40%, desirably at least 50%, by weight of the total solvent used. When present, other solvent components will desirably be used at level typically of from 1 to 90, usually 1 to 75%, more desirably 2 to 60, and particularly 5 to 50% by weight of the total carrier fluid used.

For convenience, the compound(s) of the formula (I), or mixtures including them, used in cleaning methods and included in cleaning formulations according to the invention are for brevity sometimes referred to simply as solvents or solvent component of cleaning formulations.

The particular formulation and form of composition used in various embodiments of the invention vary depending on the particular cleaning duty involved. In general, the cleaning formulations used in this invention include water and are generally water based. The compounds of the formula (I) are generally not miscible with water so to form solutions other components acting to compatibilities them with or solublise them in the water present will be needed. Other forms of cleaning composition include emulsions of the solvent in an aqueous phase, invert emulsions of an aqueous phase in the solvent, or microemulsions where the disperse phase particles are so fine, typically smaller than about 100 nm, that they do not greatly scatter visible light.

Generally, the formulations used in this invention will fall into one of three general types: solutions, emulsions and microemulsions. Solution and microemulsion formulations can be formulated at use concentrations or as concentrates which are diluted before use, whereas emulsions are generally formulated at use concentrations. Overall, such formulations will have compositions as indicated below (figures are percentages by weight):

Solution Formulations

| | Concentrates | | Use | |
|---|---|---|---|---|
| Component | Typical | Desirable | Typical | Desirable |
| surfactant* | 1 to 30 | 2 to 10 | 0.5 to 5 | 1 to 5 |
| hydrotrope (when used) | 1 to 15 | 1 to 10 | 0.3 to 3 | 0.5 to 2 |
| solvent | 1 to 15 | 1 to 8 | 0.1 to 6 | 0.5 to 3 |
| of formula (I) | 1 to 10 | 1 to 5 | 0.1 to 5 | 0.5 to 2 |
| other (when used) | 1 to 10 | 1 to 5 | 0.1 to 5 | 0.5 to 2 |
| builder(s) (almost always present) | 1 to 30 | 5 to 15 | 0.5 to 8 | 1 to 5 |
| water | to 100 | | to 100 | |

The surfactant will usually be present as a detergent and/or solubliser and/or wetter. Solution formulations can be formulated for direct use or after dilution in water typically by 1:5 to 1:50.

Emulsion Formulations

| | Concentrates | |
|---|---|---|
| Component | Typical | Desirable |
| surfactant* | 1 to 15 | 5 to 10 |
| solvent | 10 to 60 | 20 to 40 |
| of formula (I) | 10 to 60 | 10 to 40 |
| other (when used) | 5 to 50 | 5 to 30 |
| water (to 100) | to 100 | 55 to 75 |

The surfactant will usually be present as an emulsifier and possibly also as detergent, and will usually be a combination of two or more emulsifiers e.g. low HLB and high HLB emulsifiers. Emulsion formulations are formulated for direct use.

Microemulsion Formulations

| | Concentrates | |
|---|---|---|
| Component | Typical | Desirable |
| surfactant* | 10 to 25 | 12 to 20 |
| co-emulsifier (when used) | 1 to 10 | 2 to 8 |
| solvent | 20 to 50 | 25 to 40 |
| of formula (I) | 20 to 50 | 25 to 40 |
| other (when used) | 5 to 30 | 10 to 20 |
| water | to 100 | |

The surfactant will usually be present as an emulsifier and possibly also as a detergent, and will usually be a combination of two or more emulsifiers e.g low HLB and high HLB emulsifiers. Microemulsion formulations can be formulated either for direct use or after dilution in water in the range typically from 1:1 to 1:10. On dilution the physical form of the formulation may change to en emulsion or similar form with a differentiated solvent phase.

In cleaning formulations used in the invention, the non-solvent components will generally be of types and used in amounts as described below.

Surfactants can be present to serve a range of functions. Thus:

Detergents can be included to aid soil removal from substrates to be cleaned. Examples include:

anionic detergents such as ether sulphates (alcohol alkoxylate sulphate esters) such as sodium lauryl ether sulphate and ether phosphates e.g. those sold by Uniqema under the designation Atlas G2203 or Atlas G2207, alkyl and alkaryl sulphonates such as isopropyl amine dodecylbenzene sulfonate; alcohol sulphates, sulphosuccinate mono- and di-esters, ether carboxylates; and non-ionic detergents such as alkyl phenol ethoxylates, alcohol alkoxylates, particularly ethoxylates, including those sold by Uniqema under the designation "Synperonic", particularly grades such as A7, 91/2.5, 91/5 13/10, NCA 850, NCE 7 and LF/RA 30, and under the trade designation Brij 30, sorbitan fatty acid esters, ethoxylated sorbitan fatty acid esters such as sorbitan mono-oleate 20EO as sold by Uniqema under the designation Tween 20, sorbitol esters such as sorbitol hexaoleate, ethoxylated fatty acid esters, and alkylene oxide block copolymers.

Typical proportions of detergent are from 1 to 30%, more usually from 1 to 20%, and desirably from 1 to 10%, by weight of the cleaning formulation.

Emulsifiers for the solvent(s) will typically be non-ionic surfactants such as alcohol alkoxylates and ethoxylated sorbitan fatty acid esters, and in particular blends of low HLB (hydrophile lipophile balance) and high HLB emulsifiers. Typical proportions of emulsifiers are from 1 to 20%, more usually from 1 to 15%, and desirably from 1 to 10%, by weight of the cleaning formulation.

The functions of detergents and emulsifiers may overlap so the same material may provide both functions.

Wetters (wetting agents) can be included to aid wetting of the substrate. Examples include nonionic surfactants such as alcohol alkoxylates, particularly of relatively short chain e.g. C8 to C11, alcohols with relatively short polyalkylenoxy chains e.g. containing up to 6 alkylene oxide residues, and anionic surfactants such as sulphosuccinates. Typical proportions of wetters are from 1 to 10%, more usually 2 to 10%, and desirably 2 to 7%, by weight of the cleaning formulation.

Non surfactant materials that can be present include:

Hydrotropes can be includes to maintain solubility of the surfactant materials, particularly non-ionic surfactants. Anionic surfactants such as sulphonates and phosphate esters, cationic surfactants such as quaternary ammonium compounds and nonionic surfactants such as alkyl polysaccharides. Typical concentrations for hydrotropes are from 1 to 25%, more usually from 1% to 15%, and desirably from 1% to 10%, by weight of the cleaning formulation.

Builder materials can be included to enhance the effectiveness of the surfactants used, Examples include phosphates, orthophosphates, polyphosphates such as tetrapotassium pyrophosphate, silicates and/or metasilicates such as sodium metasilicate, and organic builders such as hydroxycarboxylic acids and their water soluble, particularly alkali metal e.g. Na or K, salts, such as citrates e.g. sodium citrate and gluconates, phosphonic acids and phosphonoalkane carboxylic acids and their water soluble particularly alkali metal e.g. Na or K, salts. Typical proportions of builders are from 1 to 50%, more usually from 2 to 30%, and desirably from 5 to 20%, by weight of the cleaning formulation.

Sequestrants can be included to particularly to reduce the concentration of metal ions e.g. those of Ca and Mg or of heavy metals, in the cleaning environment. Suitable sequestrants can include N-carboxylated polyamine salts such as the alkali metal e.g. Na or K, salts of ethylene diamine tetra-acetic acid (EDTA), nitrilotriacetic acid (NTA), polycarboxylic acids, hydroxycarboxylic acids such as citric acid, polyacrylic acids, gluconic and heptanoic acids. Typical concentrations of sequestrants are from 1 to 30%, more usually from 1 to 20%, and desirably from 2 to 10%, by weight of the cleaning formulation.

Alkali such as sodium hydroxide or triethanolamine, can be included to maintain an alkaline environment to aid fat removal by saponification. Typical concentrations of are from 1 to 20%, more usually from 1 to 10%, and desirably from 2 to 7%, by weight of the cleaning formulation.

Acids such as phosphoric acid (usually as ca 85% by weight aqueous solution) can be included to facilitate the removal of, for example, calcareous deposits. Typical concentrations of acids are from 1 to 50%, more usually from 2 to 30%, and desirably from 5 to 20%, by weight of the cleaning formulation.

Solids such as mild abrasives can be included to aid mechanical removal of soil from substrates. Typical amounts of such solids are from 1 to 20% more usually from 0 (1) to 10%, and desirably from 1 to 5%, by weight of the cleaning formulation.

Corrosion inhibitors can be included to reduce or prevent corrosion particularly on metal substrates such as iron and steels, including stainless, nickel and chrome steels, copper, brasses, bronzes, bronzes, aluminium, silumin and duralumin. Examples include straight or branched chain, particularly C8 to C11, alkanecarboxylic acids and their water soluble, e.g. alkali metal, such as Na or K, or ammonium such as alkanolammonium, salts. Typical concentrations of corrosion inhibitors are from 1 to 10%, more usually from 2 to 10%, and desirably from 2 to 7%, by weight of a concentrated cleaning formulation.

Anti foam agents are used, particularly in compositions for use in spray cleaning, and examples of anti foams include water soluble or dispersible organopolysiloxanes and nonionic surfactants such as alcohol ethoxylate propoxylates e.g. that sold by Uniqema under the designation Synperonic LF/RA 260. Typical concentrations of anti foams are from 0.01 to 10%, more usually from 0.1 to 5%, and desirably from 0.5 to 2%, by weight of the cleaning formulation.

Other materials that can be present in the cleaning compositions include stabilisers, preservatives, particularly biocides such as anti-microbials, perfume and dye, typically at conventional levels.

The conditions of cleaning will vary with the application. Thus, temperature can vary from ambient temperature, particularly for domestic use, to moderately elevated temperatures which may be used in industrial cleaning e.g. metal degreasing. Typically the temperature will be in the range 15 to 80° C. The pH of the cleaning medium can vary from moderately acid to strongly alkali e.g. 4 to 13.5, but more usually 9 to 13.5 (by the inclusion of alkaline e.g. Na or K, hydroxides or carbonates), and in particular used at moderately elevated temperatures e.g. 40 to 80° C.

The cleaning technique can vary from manual application and rubbing to spraying and dipping as used in industrial cleaning. Particularly in industrial cleaning, energy may be provided by mechanical agitation or sonically e.g using ultrasound.

In domestic hard surface cleaning, the formulations are usually solutions, emulsions or microemulsions and are usually retailed at ready to use concentrations, and are typically applied to the substrate to be cleaned by spraying, scrubbing, wiping or brushing and cleaning will usually be augmented by mechanical rubbing or wiping.

For institutional and industrial cleaning applications the formulations are usually emulsions or microemulsions and are typically applied to the substrate to be cleaned by spraying, scrubbing, wiping, or by machines using such application actions.

In industrial cleaning in food related applications, such as in dairies, breweries and food processing plants, the formulations are usually applied by spraying, immersion, particularly by passing the cleaning medium through the equipment e.g. down a line or pipe to be cleaned, wiping and brushing.

For industrial degreasing, the formulations are usually solutions, emulsions or microemulsions and are usually applied by spraying, immersion, wiping and/or brushing. Degreasing it typically used in metal forming operations or in cleaning substrates which acquire oil or grease or similar contamination during industrial fabrication operations such as electronic circuit boards.

A related cleaning application is rig cleaning which is the cleaning of oilfield equipment e.g. at the head of an oil drilling or production well. For such applications the cleaner is usually provided as a microemulsion which is diluted with water before use. Reducing environmental damage is particularly important in marine oilfield operations and in such situations it is usual to use brine (seawater) as the dilution water.

In paint stripping and graffiti removal the proportion of solvent, including compound(s) of the formula (I) and where used other solvents, will generally be higher than for general cleaning applications. Typically, they can be similar to cleaners for removing tenacious oily soils. For these applications, the total proportion of solvent will usually be at least 10% and may be as high as 90% of the total cleaning material. Cleaners having, within this broad range, lower proportions of solvent will usually have relatively higher proportions of detergent surfactants and those with higher proportions of solvent can use lower concentrations of detergent. Thus, a water based paint stripper or graffiti remover may have (by weight) from 15 to 25% solvent and 25 to 30% of non-ionic detergents or a water based emulsion formulation may contain from 40 to 65% of solvent dispersed in an aqueous phase including 15 to 25% detergent. The solvent is desirably a mixture of compound(s) of the formula (I) with other solvents e.g. limonene and the detergents are desirably alcohol ethoxylate(s) and/or fatty acid ethoxylates and may include a mix of low and high HLB detergents. The formulations may also contain, sequestrants e.g EDTA or NTA at from 5 to 10% by weight.

Examples of typical formulations include (the solvent being or including a compound of the formula (I), particularly iso-propyl benzoate—percentages are by weight):

| Heavy Duty Hard Surface Cleaner | |
|---|---|
| sodium lauryl ether sulphate (27% active) | 13% |
| alcohol ethoxylate | 4% |
| solvent | 4% |
| tetrapotassium pyrophosphate | 5% |
| preservative, perfume and dye | as required |
| water | to 100% |

Used as is or in dilution in water for range of typical household substrates and soils.

| Metal Degreasing Formulations - used as is or in dilution in water (typically 1:10) | | |
|---|---|---|
| 1 | solvent | 28% |
| | anionic sulphonate detergent | 13% |
| | ethoxylated sorbitan ester | 6% |
| | iso-hexanol | 4% |
| | water | to 100% |
| 2 | Solvent | 15% |
| | low HLB alcohol ethoxylate | 14% |
| | high HLB alcohol ethoxylate | 6% |
| | quaternary ammonium hydrotrope | 2.5% |
| | ethanol | 4% |
| | tetrapotassium pyrophosphate | 2% |
| | EDTA Na4 | 1% |
| | water | to 100 |
| 3 | solvent | 33% |
| | surfactant blend* | 17% |
| | water | to 100% |
| Heavy Duty Emulsion Cleaner | | |
| | solvent | 60% |
| | ethoxylated fatty acid | 14% |
| | alcohol ethoxylate | 6% |
| | water | to 100 |
| Railway Wagon External Cleaner | | |
| | alcohol ethoxylate | 10% |
| | phosphoric acid (85%) | 40% |
| | alkyl phosphate ester | 15% |
| | solvent | 5% |
| | water | to 100% |
| Offset Printing Plate Cleaner | | |
| | solvent | 15 to 20% |
| | low HLB alcohol ethoxylate | 12 to 14% |
| | high HLB alcohol ethoxylate | 14 to 16% |
| | NTA (38%) | 5 to 7% |
| | butyl diglycol | 2 to 3% |
| | Water | to 100 |
| Truck Wash Formulation | | |
| | sodium hydroxide | 2% |
| | sodium metasilicate | 1% |
| | sodium gluconate | 2% |
| | EDTA Na4 | 1% |
| | low foam wetter* | 5% |
| | solvent | 3% |
| | Atsurf H1500 | 3% |
| | water | to 100% |

*commercial blend of anionic nonionic and cationic surfactants
*alcohol ethoxylate propoxylate This truck wash formulation is typically used in aqueous dilution from 1:10 to 1:50 depending on the nature of the soil etc. The substrate is typically painted metal. Formulations can be applied by spraying at temperatures between ambient and 60° C.

| Screenwash Formulations | | |
|---|---|---|
| 1 | alcohol ethoxylate | 1% |
| | triethanolamine | 0.2 to 0.5% |
| | solvent | to 100 |
| 2 | alcohol ethoxylate | 2% |
| | triethanolamine | 0.2% |
| | tetrapotassium pyrophosphate | 2% |
| | glycerine | 2.5% |
| | iso-propanol | 42% |
| | solvent | 42% |
| | water | to 100% |

These are concentrates which typically used are diluted from 1:20 to 1:100 in water for use on car windscreens.

| Hand Cleanser | |
|---|---|
| solvent | 40% |
| nonionic/anionic surfactant blend | 12% |
| anionic surfactant | 0.5% |
| glycerine | 1% |
| mineral oil | 2% |
| water | to 100 |

This formulation is typically used as is to remove oil and grease from hands.

The following Examples illustrate the invention. All parts and percentages are by weight unless otherwise specified.

| Materials | |
|---|---|
| Sol1 | iso-propyl benzoate |
| Sol2 | 2-ethylhexyl benzoate |
| CSol1 | D-limonene |
| CSol2 | N-methyl pyrrolidone |
| CSol3 | benzyl alcohol |
| H1C | commercial domestic hard surface cleaner (Mr Muscle) ex SC Johnson Wax |
| H1 | H1C with 1% by weight Sol1 added |
| H2C | commercial domestic hard surface cleaner ex Mc Brides |
| H2 | H2C with 1% by weight Sol1 added |
| D3 | water based Sol1 (based) metal degreaser formulation |
| D3C | water based Sol2 (based) metal degreaser formulation |
| Surf1 | a 1:1 mixture of Synperonic 91/2.5 and Synperonic 91/6 both ex Uniqema |
| Surf2 | Monamulse DBE—a mixture of non-ionic and anionic surfactants ex Uniqema |

Test Methods

Scrub Testing

A white tile surface, cleaned with acetone and dried with a laboratory paper tissue, is coated with a test kitchen soil prepared by mixing: carbon black (7 g); gravy granules (95 g); lard (90 g); gelatine (12 g); and water (796 g)—total 1000 g and warming until homogenous. The soil is applied to the top edge of the tile as an even line of warm soil and spread over the tile surface using a warmed wire wound bar (No 6 k-bar); baked on the tile in a pre-heated oven at 70° C. for 1 hour; and allow to cool to ambient temperature. The soil is coulometrically measured using a Gardner spectrophotometer (Delta E value) at a noted point of measurement (so that later measurements are at the same place); the soiled plate clipped onto the scrub tester platform and three drops of the test cleaning agent applied to the tile surface. The scrub tester is a mechanical arm with a sponge on the end which can reciprocally rub the test surface to simulate cleaning by scrubbing using a load on the sponge of 160 $N.m^{-2}$ and a stroke length of 12 cm. The tile is rubbed in groups of 5 rubs (1 rub=once forwards and back) and the colour of the test location is measured. The assessed cleaning efficiency is the difference between in the Delta E value of the scrubbed tile less that of the tile originally. Multiple runs may be used and average results quoted.

Metal Degreasing

Steel test coupons of uniform size and material are cleaned in acetone and dried in air. The clean coupons are weighed (in g to 0.1 mg) and coated with soil. The test soil is a mixture of: stearic acid (15 g); oleic acid (15 g); solid vegetable fat (30 g); lubricating oil (e.g. engine oil) (25 g); and octadecanol (stearyl alcohol) (8 g)—total 93 g. Each test coupon is dipped, up to a premade mark on the coupon, into the molten test soil at a known temperature for approximately 2 seconds allowed to cool in ambient air until the dirt solidifies after which the coupon is reweighed to determine the amount of soil on the coupon (ca 0.2 g).

The test cleaning solution, an aqueous cleaning mix containing 3% by weight solution of the test solvent and 3% by weight Surf1, is placed in the Zeltex Vista Color tester apparatus and allowed to reach test temperature, usually 40 or 60° C. Each coupon is lowered into the test solution; moved up and down in a helicoidal motion for a set time (sufficient for realistic comparison between test solutions); removed from the test solution; allowed to dry in ambient air; and reweighed to determine the amount of soil removed. The assessed cleaning efficiency is the (weight) percentage of the soil initially present that is removed by the washing. Duplicate runs are carried out with mean results quoted.

Paint Stripping

The surface of metal plates were sprayed with acetone to clean them and allowed to dry in air at ambient temperature. An even layer of test paint was applied to the metal plate using a 1 inch (ca 25 mm) brush, and left to dry for 7 days at ambient temperature.

2 ml of test solvent was applied to the painted surface by pipette as a continuous line, of equal length for each test solvent. The effects were then observed at 30, 60, and 90 minutes (testing neat solvents) or 10, 20 and 30 minutes (for solvent mixtures). Observations and 'effect' were recorded using a ranking scale of paint stripping performance from 1=poor (no stripping) to 5=good (complete paint removal).

Note: acrylic paints required solvents wiping off (one wiping motion from top to bottom along solvent line, applying similar manual pressure for each test) with an Industrial tissue after the test time in order to assess paint removal.

EXAMPLE 1

The ability of a compound of the formula (I) (iso-propyl benzoate) to boost the effectiveness of commercially available surface cleaning detergents was tested using the scrub cleaning tests. Comparison tests were run with the commercial materials alone. The results are set out in Table 1 below, from which it is clear the at the inclusion of iso-propyl benzoate substantially increases the effectiveness of the cleaners.

TABLE 1

| Ex | | Cleaning Efficiency (%) No of Rubs | | | |
|---|---|---|---|---|---|
| No | Cleaner | 0 | 5 | 10 | 15 |
| C1.1 | H1C | 0 | 34 | 68 | 72 |
| 1.1 | H1 | 0 | 52 | 79 | 88 |
| C1.2 | H2C | 0 | 52 | 62 | 72 |
| 1.2 | H2 | 0 | 59 | 86 | 91 |

EXAMPLE 2

The performance of iso-propyl benzoate as a component of aqueous cleaning systems was compared with limonene (promoted as a low environmental impact cleaning solvent). The results of comparative scrub cleaning testing is set out in Table 2 from which it is clear that the formulation including iso-propyl benzoate gave better results than the limonene formulation.

TABLE 2

| Ex | | Cleaning Efficiency (%) No of Rubs | | | |
|---|---|---|---|---|---|
| No | Cleaner | 0 | 5 | 10 | 15 |
| C1.2 | D3C | 0 | 23 | 37 | 49 |
| 1.2 | D3 | 0 | 59 | 70 | 88 |

EXAMPLE 3

A water based metal degreasing formulation of using iso-propyl benzoate as cleaning solvent in water was tested for metal degreasing for test periods of 5 or 10 minutes. Similar preparations made using d-limonene as the solvent were made and tested for comparison. The test results (the mean of replicated tests) are set out in Table 3 below. The results again indicate that the iso-propyl benzoate formulation performs better than the limonene formulation, particularly in the shorter test runs.

TABLE 3

| Ex No | Formulation | Time (min) | Eff (%) |
|---|---|---|---|
| 3.1 | D3 | 5 | 44 |
| 3.2 | D3 | 10 | 57 |
| C3.1 | DC3 | 5 | 24 |
| C3.2 | DC3 | 10 | 54 |

EXAMPLE 4

The ability of Sol1 and Sol2 to function as paint removers for alkyd, acrylic and urethane paints was investigated. Using the method described above, tests were run using neat solvents Sol1 and Sol2 with CSol1 and CSol2 for comparison and with blends of Sol1 and Sol2 with CSol3 and 5 Csol4. The results are set out in Table 4 below.

TABLE 4

| Ex | Solvent | | co-solvent | | Paint type | | |
|---|---|---|---|---|---|---|---|
| No | type | % | type | % | Alkyd Gloss | Acrylic | Urethane |
| 4.1 | Sol1 | 100 | — | — | 0 | 5 | 5 |
| C4.1 | Csol1 | 100 | — | — | 0 | 0 | 5 |
| 4.2 | Sol2 | 100 | — | — | 5 | 5 | 5 |
| C4.2 | Csol2 | 100 | — | — | 5 | 5 | 5 |
| 4.3 | Sol2 | 90 | CSol2 | 10 | 3 | 5 | 5 |
| C4.3 | CSol1 | 90 | CSol2 | 10 | 0 | 0 | 4 |
| 4.4 | Sol1 | 90 | CSol2 | 10 | 5 | 5 | 5 |
| 4.5 | Sol2 | 90 | CSol3 | 10 | 4 | 5 | 5 |
| C4.4 | CSol1 | 90 | CSol3 | 10 | 0 | 4 | 1 |
| 4.6 | Sol2 | 60 | CSol2 | 20 | 4 | 5 | 5 |
| 4.7 | Sol1 | 80 | CSol2 | 20 | 5 | 5 | 5 |
| 4.8 | Sol2 | 80 | CSol3 | 20 | 5 | 5 | 5 |
| C4.5 | CSol1 | 80 | CSol3 | 20 | 0 | 3 | 1 |

EXAMPLE 5

The ability of compounds described in formula 1 to remove used engine oil as soil (substituted for the synthetic soil used in the standard method described above) with a treatment time of 1 minute. The results are set out in Table 5 below.

TABLE 5

| Ex No | Solvent | Temp (° C.) | Efficiency (%) |
|---|---|---|---|
| 5.1 | Sol2 | 20 | 89.4 |
| 5.2 | Sol2 | 40 | 88.5 |

EXAMPLE 6

A microemulsion detergent formulation was made up having the following composition:

| Material | parts by wt |
|---|---|
| Surf 2 | 28.3 |
| Sol1 | 44 |
| Water | to 100 |

This formulation was tested as a 9:1 dilution in water for removal of the synthetic soil from test coupons as described above with treatment temperature of 40° C. for a time of 10 minutes. The measured degreasing efficiency was 97%.

What is claimed is:

1. A method of cleaning a substrate, which includes contacting the substrate to be cleaned with a composition, particularly and aqueous composition, including at least one compound of the formula (I):

$$(R^2)_p—Ph—(CH_2)_m—COO—(AO)_n—R^1 \quad (I)$$

where $R^1$ is a $C_1$ to $C_{20}$ alkyl or alkenyl group;

AO is an alkyleneoxy group and may vary along the (poly)alkyleneoxy chain;

n 0 or from 1 to 100;

m is 0, 1 or 2; and

Ph is a phenyl group, which may be substituted with groups $(R^2)_p$; where each $R^2$ is independently a $C_1$ to $C_4$ alkyl or alkoxy group; and p is 0, 1 or 2.

2. A method as claimed in claim 1 wherein m, n and p are all 0.

3. A method as claimed in claim 1, wherein R1 is a $C_1$ to $C_{10}$ alkyl group, preferably a $C_3$ to $C_5$ branched alkyl group.

4. A method as claimed in claim 1, wherein the compound of the formula (I) is or includes iso-propyl benzoate.

5. A method as claimed in claim 1 for degreasing a substrate, particularly a metal substrate, by contacting the substrate with a composition, particularly an aqueous composition, including at least one compound of the formula (I).

6. A method as claimed in claim 1 for hard surface cleaning, by contacting a hard surface to be cleaned with a composition, particularly an aqueous composition, including at least one compound of the formula (I) together with a surfactant, particularly a detergent surfactant, and a builder or alkali.

7. A method as claimed in claim 1 for cleaning graffiti from a surface in which the surface to be cleaned is contacted with a composition, particularly an aqueous composition, including at least one compound of the formula (I) together with a surfactant.

8. A method as claimed in claim 1 for stripping paint from a substrate in which a painted substrate is contacted with a composition, particularly an aqueous composition, including at least one compound of the formula (I) together with a surfactant, particularly a detergent surfactant.

9. A method as claimed in claim 1 for rig cleaning in which the surface of the rig to be cleaned is contacted with an aqueous microemulsion composition including at least one compound of the formula (I) together with a surfactant, particularly a detergent surfactant.

10. The method of claim 1 wherein said compositions is an aquesous emulsion or microemulsion; $R^1$ is a $C_6$ to $C_{20}$ alkyl or alkenyl group; n=0; and m=0.

11. The method of claim 10 wherein p=0.

12. The method of claim 10 wherein $R^1$ is a $C_6$ to $C_{10}$ alkyl group.

13. The method of claim 12 wherein said $C_6$ to $C_{10}$ alkyl group is a branched alkyl group.

14. The method of claim 10 wherein the compound of formula (I) is 2 -ethylhexyl benzoate.

15. The method of cleaning according to claim 10 wherein said substrate is degreased.

16. The method of claim 15 wherein said substrate is metal.

17. The method of claim 10 wherein said composition further comprises a surfactant.

18. The method of claim 17 wherein said surfactant is a detergent surfactant.

19. The method of clam 17 wherein said composition is for hard surface cleaning and further comprises a builder or an alkali.

20. The method of clam 18 wherein said composition is for hard surface cleaning and further comprises a builder or an alkali.

21. The method of claim 17 wherein graffiti is cleaned from said substrate.

22. The method of claim 17 wherein said substrate is painted and said cleaning removes said paint from said substrate.

23. The method of claim 18 wherein said substrate is painted and said cleaning removes said paint from said substrate.

24. The method of claim 17 wherein said substrate is a rig.

25. The method of claim 18 wherein said substrate is a rig.

26. The method of claim 11 wherein $R^1$ is a $C_6$ to $C_{10}$ alkyl group.

27. The method of claim 11 wherein $R^1$ is a $C_6$ to $C_{10}$ branched alkyl group.

* * * * *